US011626223B2

(12) United States Patent
Chen et al.

(10) Patent No.: US 11,626,223 B2
(45) Date of Patent: Apr. 11, 2023

(54) GRAPHENE-CONTAINING RARE EARTH PERMANENT MAGNET MATERIAL AND PREPARATION METHOD THEREOF

(71) Applicant: Dongguan Jinconn New Material Co., Ltd., Dongguan (CN)

(72) Inventors: Song Chen, Dongguan (CN); Liang Chen, Dongguan (CN); Xiangyang Liu, Dongguan (CN); Wei Li, Dongguan (CN)

(73) Assignee: DONGGUAN JINCONN NEW MATERIAL CO., LTD., Dongguan (CN)

( * ) Notice: Subject to any disclaimer, the term of this patent is extended or adjusted under 35 U.S.C. 154(b) by 0 days.

(21) Appl. No.: 17/382,796

(22) Filed: Jul. 22, 2021

(65) Prior Publication Data

US 2022/0301752 A1 Sep. 22, 2022

(30) Foreign Application Priority Data

Mar. 16, 2021 (CN) ..... 202110281792.4

(51) Int. Cl.

| | |
|---|---|
| ***H01F 1/057*** | (2006.01) |
| ***C22C 38/00*** | (2006.01) |
| ***C22C 38/16*** | (2006.01) |
| ***B22F 3/16*** | (2006.01) |
| ***B22F 3/24*** | (2006.01) |
| ***C22C 38/10*** | (2006.01) |

(52) U.S. Cl.

CPC ..... *H01F 1/0577* (2013.01); *B22F 3/16* (2013.01); *B22F 3/24* (2013.01); *C22C 38/002* (2013.01); *C22C 38/005* (2013.01); *C22C 38/10* (2013.01); *C22C 38/16* (2013.01); *H01F 1/0576* (2013.01); *B22F 2003/248* (2013.01); *B22F 2202/05* (2013.01); *B22F 2301/355* (2013.01); *B22F 2302/40* (2013.01); *C22C 2202/02* (2013.01)

(58) Field of Classification Search

None

See application file for complete search history.

(56) References Cited

FOREIGN PATENT DOCUMENTS

CN 106847457 A * 6/2017

* cited by examiner

*Primary Examiner* — Anthony M Liang

(57) ABSTRACT

The present invention involves a graphene-containing rare earth permanent magnet material and preparation method thereof. The graphene-containing rare earth permanent magnet material, comprising: 20.6 to 23.4 weight percent of neodymium, 6.6 to 7.5 weight percent of praseodymium, 0.95 to 1.20 weight percent of boron, 0.4 to 0.6 weight percent of cobalt, 0.11 to 0.15 weight percent of copper, 2.0 to 2.4 weight percent of lanthanum, 1.7 to 2.1 weight percent of cerium, 1 to 5 weight percent of graphene, a remainder being iron. The graphene-containing rare earth permanent magnet material exhibits excellent temperature resistance, good conductivity and magnet properties even without any heavy rare earth elements like terbium or dysprosium, which dramatically reduces the cost, promotes the efficient utilization of rare earth resources and improves product quality. The preparation method within this invention is simple to realize, easy to control, cost-effective and has high production efficiency and stable product performances.

8 Claims, No Drawings

GRAPHENE-CONTAINING RARE EARTH PERMANENT MAGNET MATERIAL AND PREPARATION METHOD THEREOF

CROSS REFERENCE TO PRIORITY APPLICATIONS

This application claims the benefit of Chinese Application 202110281792.4 for a graphene-containing rare earth permanent magnet material and preparation method thereof (filed Mar. 16, 2021 at the China National Intellectual Property Administration, CNIPA). The disclosures of the above applications are incorporated herein by reference.

FIELD OF THE INVENTION

The present invention relates to a permanent magnet material, in particularly to a graphene-containing rare earth permanent magnet material and preparation method thereof.

BACKGROUND OF THE INVENTION

Neodymium-iron-boron (Nd—Fe—B) permanent magnet materials comprise mainly of rare earth elements of neodymium, boron and iron. A large amount of heavy rare earth elements like dysprosium and terbium are included in Nd—Fe—B permanent magnetic materials to obtain high-performance permanent magnet materials in existing technologies. Recently, with the economic development and social progress, the Nd—Fe—B permanent magnetic materials are widely applied in various fields like machinery, transportation, energy, medical services, information technology and household appliances, leading to an increasing demand for Nd—Fe—B permanent magnetic materials. However, due to the high cost of rare earth mining, dysprosium, terbium and other heavy rare earth metals suffer from problems like high price, lack of supply and strict controlling policies. Moreover, temperature resistance, conductivity and product stability of Nd—Fe—B based permanent magnet materials still need to be improved in the prior art.

SUMMARY OF THE INVENTION

To overcome the shortcomings and deficiencies in the prior art, an object of the present invention is to provide a graphene-containing rare earth permanent magnet material that can decrease the usage of rare earth elements like dysprosium and terbium and reduces the cost via incorporating graphene. Furthermore, the graphene-containing rare earth permanent magnet material exhibits excellent properties such as good temperature resistance, conductivity and magnet properties, as well as stable performance.

A further object of the present invention is to provide a method for preparing the graphene-containing rare earth permanent magnet material, which is simple, easy to control, cost-effective and highly productive. The graphene-containing rare earth permanent magnet material prepared by this method exhibits stable performance, good temperature resistance, excellent conductivity and magnetic properties.

The graphene-containing rare earth permanent magnet material in the present invention comprising: 20.6 to 23.4 weight percent of neodymium, 6.6 to 7.5 weight percent of praseodymium, 0.95 to 1.20 weight percent of boron, 0.4 to 0.6 weight percent of cobalt, 0.11 to 0.15 weight percent of copper, 2.0 to 2.4 weight percent of lanthanum, 1.7 to 2.1 weight percent of cerium, 1 to 5 weight percent of graphene, a remainder being iron.

The graphene-containing rare earth permanent magnet material of the present invention incorporates graphene as a component and becomes a high-performance magnet material through compounding with other raw materials of iron, praseodymium, neodymium, boron, cobalt, copper, lanthanum and cerium. Dysprosium and terbium are strategic rare earth elements that suffers from problems like high price, lack of supply and strict controlling policies. However, compounding graphene with the above-mentioned raw materials can reduce and even replace and the usage of heavy rare earth elements like dysprosium and terbium, which simultaneously reduces the cost, improves the quality and performances such as temperature resistance, conductivity and magnetic properties of the magnet material.

The preparation method of the graphene-containing rare earth permanent magnet material in this invention comprises of the following steps:

S1. proportionally mixing a graphene powder with a magnet alloy powder to obtain a graphene-containing rare earth permanent magnet powder, the magnet alloy powder contains neodymium, praseodymium, boron, cobalt, copper, lanthanum, cerium and iron in proportion; orientating the graphene-containing rare earth permanent magnet powder under a magnet field with the protection of an inert gas, and pressing the oriented graphene-containing rare earth permanent magnet powder to form a green body;

S2. isostatic pressing the green body obtained from S1; sintering the isostatic pressed green body in a sintering furnace; tempering the sintered green body to obtain a graphene-containing rare earth permanent magnet material.

In accordance with the preparation step S1, preferably, the magnet alloy powder is prepared by the following steps: mixing neodymium, praseodymium, boron, cobalt, copper, lanthanum, cerium and iron powder in proportion to form a magnet alloy; then smelting the magnet alloy to form a magnet alloy ingot; the magnet alloy ingot is made into thin magnet alloy sheets by a rapid solidification process; the thin magnet alloy sheets are then treated by hydrogen decrepitation to form the magnet alloy fragments; the magnet alloy fragments are then processed into magnet alloy powders by jet milling.

In accordance with the preparation step S1, in the rapid solidification process, the processed molten state magnet alloy is poured onto a rotating water-cooled copper rolls for rapid quenching, with a rotation speed of 2.5 m/s to 3 m/s. The thin sheets obtained from the rapid solidification in step S1 have fine and uniform grains, good grain orientation and good magnetic properties. Preferably, the thin sheets obtained from the rapid solidification in step S1 have a thickness of 0.2 mm-0.4 mm. The thin sheets obtained from the rapid solidification in step S1 of the present invention have intact lamellar crystal structure from the roller surface to the free surface with the neodymium-praseodymium rich phase evenly distributed along the main phase. Meanwhile, they show good temperature resistance, conductivity and magnetic properties.

In accordance with the preparation step S1, preferably, the magnet alloy powder has a diameter of 0.5 nm-1.5 nm.

In accordance with the preparation step S1, the graphene-containing rare earth permanent magnet powder is orientated under a magnet field with a magnet field strength of 1.6 T-2.5 T.

In accordance with the preparation step S2, preferably, the pressure of the isostatic pressing is 230 MPa-280 MPa, and the treatment time of the isostatic pressing is 90 s-150 s.

In accordance with the preparation step S2, preferably, the sintering process comprises the following steps:

A: placing the isostatic treated green body in a sintering furnace, closing the furnace lid and evacuating the furnace until the absolute vacuum degree in the furnace is below 0.1 Pa;

B: feeding the sintering furnace with argon until pressure in the sintering furnace reaches 60 Pa-100 Pa and keeping at this pressure; increasing temperature of the sintering furnace to 260° C.-310° C. at a heating rate of 2.5° C./min-3.5° C./min and keeping at this temperature. The heating and holding time is 150 mins-200 mins;

C: continuing to feed the sintering furnace with argon until the pressure in the sintering furnace reaches 200 Pa-250 Pa and keeping at this pressure; increasing temperature of the sintering furnace to 760° C.-820° C. at a heating rate of 3° C.-4° C./min;

D: stop feeding argon and then evacuating the furnace until the absolute vacuum degree in the furnace is below 0.1 Pa; increasing temperature of the sintering furnace to 1050° C.-1140° C. at a heating rate of 2° C./min-3° C./min and keeping temperature of the furnace at the target temperature. The heating and holding time is 240 mins-300 mins.

In the present invention, the graphene-containing rare earth permanent magnet powder is prepared by proportionally mixing magnet alloy powder consisting of proportions of neodymium, praseodymium, boron, cobalt, copper, lanthanum, cerium and iron with graphene powder to modify Nd—Fe—B permanent magnet materials. Then, the graphene-containing rare earth permanent magnet powder is orientated under a magnet filed and pressed into a green body. The green body is then isostatic pressed and sintered. Following the above sintering steps with strict control over the processing parameters of each step, the sintering process in this invention can effectively promotes the stable combination between the graphene powder and the magnet alloy powder during sintering. Meanwhile, the green body of the graphene-containing rare earth permanent magnet material can be well-protected with the inert gas from oxidation. Moreover, the tiny pressure difference between the gas inside the green body and that in the external sintering furnace can effectively prevent cracks forming inside the green body and thus endows the magnet with good uniformity. The magnet obtained show excellent temperature resistance, conductivity and magnetic properties. With reduced usage of scarce heavy rare earth elements, the preparation method in the present invention is simple to realize, easy to control, cost-effective and has high production efficiency, high yield and stable product performances, which all make it suitable for industrial production.

In accordance with the preparation step S2, preferably, the graphene-containing rare earth permanent magnet material is obtained via first isostatic pressing of the green body obtained from the preparation step S1, sintering the isostatic pressing treated green body in a vacuum sintering furnace, and then tempering the sintered green body following a two-stage tempering process.

In accordance with the preparation step S2, preferably, the two-stage tempering process is conducted at 860° C.-940° C. for 120 mins-180 mins of a first stage and 550° C.-600° C. for 120 mins-180 mins of a second stage. By adopting the above-mentioned tempering process and controlling its processing parameters, the graphene-containing rare earth permanent magnet material has stable grains with uniform size and the magnetic properties are greatly improved. Meanwhile, stability of product performances as well as temperature resistance, conductivity and the mechanical strength of the Nd—Fe—B permanent magnet materials are all improved.

The beneficial effects of the present invention are as follows: the graphene-containing rare earth permanent magnet material is formed by incorporating graphene into Nd—Fe—B magnet alloy powders. By adjusting the contents of various components, the graphene-containing rare earth permanent magnet material has good temperature resistance, conductivity and magnetic properties and more importantly it does not contain any heavy rare earth elements such as terbium or dysprosium. The graphene-containing rare earth permanent magnet material in the present invention shows improved performances while significantly decreased cost of rare earth permanent magnet materials. It can promote the effective utilization of rare earth resources and increase the yield of rare earth permanent magnet materials. The preparation method in the present invention is simple to realize, easy to control, cost-effective and has high production efficiency and stable product performances.

DETAILED DESCRIPTION OF THE INVENTION

To facilitate the understanding of those skilled in the art, the present invention will be further explained in combination with the following specific embodiments, but the protection is not limited thereto.

[The First Embodiment]

The graphene-containing rare earth permanent magnet material in the first embodiment comprises 21.5 weight percent of neodymium, 6.9 weight percent of praseodymium, 1.1 weight percent of boron, 0.5 weight percent of cobalt, 0.12 weight percent of copper, 2.2 weight percent of lanthanum, 1.9 weight percent of cerium, 3 weight percent of graphene, a remainder being iron.

The preparation method of the graphene-containing rare earth permanent magnet material in the first embodiment includes the following steps:

S1: proportionally mixing a graphene powder with a magnet alloy powder to obtain a graphene-containing rare earth permanent magnet powder; the magnet alloy powder contains neodymium, praseodymium, boron, cobalt, copper, lanthanum, cerium and iron in proportion; orientating the graphene-containing rare earth permanent magnet powder under a magnet field with the protection of an inert gas, and pressing the oriented graphene-containing rare earth permanent magnet powder to form a green body;

S2: isostatic pressing the green body obtained from the preparation S1; sintering the isostatic pressed green body in a sintering furnace; tempering the sintered green body to obtain a graphene-containing rare earth permanent magnet material.

In accordance with the preparation step S1, the magnet alloy powder is prepared by the following steps: mixing neodymium, praseodymium, boron, cobalt, copper, lanthanum, cerium and iron powder in proportion to form a magnet alloy; then smelting the magnet alloy to form a magnet alloy ingot; the magnet alloy ingot is then made into thin magnet alloy sheets by a rapid solidification process; the thin magnet alloy sheets are then treated by hydrogen decrepitation to form magnet alloy fragments; the magnet alloy fragments are then processed into magnet alloy powders by jet milling.

In accordance with the preparation step S1, in the rapid solidification process, the processed molten state magnet alloy is poured onto a rotating water-cooled copper rolls for rapid quenching, with a rotation speed of 2.7 m/s. Thickness of the obtained thin magnet alloy sheets is 0.3 mm.

In accordance with the preparation step S1, the diameter of the magnet alloy powder is 0.5 μm-1.5 nm.

In accordance with the preparation step S1, the graphene-containing rare earth permanent magnet powder is orientated under a magnet field with a magnet field strength of 2 T.

In accordance with the preparation step S2, the isostatic pressing of the green body is conducted at a pressure of 250 MPa and a pressing time of 120 s.

In accordance with the preparation step S2, the sintering process comprises of the following steps:

A: placing the isostatic pressing treated green body in a sintering furnace, closing the furnace lid and evacuating the furnace until the absolute vacuum degree in the furnace is below 0.1 Pa;

B: feeding the sintering furnace with argon until pressure inside the sintering furnace reaches 80 Pa and keeping at this pressure; increasing temperature of the sintering furnace to 270° C. at a heating rate of 3° C./min and keeping at this temperature. The heating and holding time is 180 mins;

C: continuing to feed the sintering furnace with argon until the pressure in the sintering furnace reaches 230 Pa and maintaining at this pressure; increasing temperature of the sintering furnace to 800° C. at a heating rate of 3.5° C./min;

D: stop feeding argon and then evacuating the furnace until the absolute vacuum degree in the furnace is below 0.1 Pa; increasing temperature of the sintering furnace to 1100° C. at a heating rate of 2.5° C./min and keeping at this temperature. The heating holding time is 270 mins.

In accordance with the preparation step S2, the graphene-containing rare earth permanent magnet material is obtained via first isostatic pressing of the green body obtained from the preparation step S1, sintering the isostatic pressing treated green body in a vacuum sintering furnace, and then tempering the sintered green body following a two-stage tempering process.

In accordance with the preparation step S2, the two-stage tempering process is conducted at 900° C. for 150 mins of the first stage and 580° C. for 150 mins of the second stage.

[The Second Embodiment]

The graphene-containing rare earth permanent magnet material in the second embodiment comprises 20.6 weight percent of neodymium, 7.5 weight percent of praseodymium, 0.95 weight percent of boron, 0.4 weight percent of cobalt, 0.11 weight percent of copper, 2.4 weight percent of lanthanum, 1.7 weight percent of cerium, 1 weight percent of graphene, a remainder being iron.

The preparation method of the graphene-containing rare earth permanent magnet material in the second embodiment is as follows:

S1: proportionally mixing a graphene powder with a magnet alloy powder to obtain the graphene-containing rare earth permanent magnet powder; the magnet alloy powder contains neodymium, praseodymium, boron, cobalt, copper, lanthanum, cerium and iron powder in proportion; orientating the graphene-containing rare earth permanent magnet powder under a magnet field with the protection of an inert gas, and pressing the oriented graphene-containing rare earth permanent magnet powder to form a green body;

S2: isostatic pressing of the green body obtained from S1; sintering the isostatic pressing treated green body in a sintering furnace; tempering the sintered green body to obtain the graphene-containing rare earth permanent magnet material.

In accordance with the preparation step S1, preferably, the magnet alloy powder is prepared by the following steps: mixing neodymium, praseodymium, boron, cobalt, copper, lanthanum, cerium and iron powder in proportion to form a magnet alloy; then smelting the magnet alloy to form a magnet alloy ingot; the magnet alloy ingot is made into thin magnet alloy sheets by a rapid solidification process; the thin magnet alloy sheets are then treated by hydrogen decrepitation to form magnet alloy fragments; the magnet alloy fragments are then processed into magnet alloy powders by jet milling.

In accordance with the preparation step S1, in the rapid solidification process, the processed molten state magnet alloy is poured onto a rotating water-cooled copper rolls for rapid quenching, with a rotation speed of 2.5 m/s. The thickness of the obtained thin magnet alloy sheets is 0.35 mm.

In accordance with the preparation step S1, the diameter of the magnet alloy powder is 0.5 nm-1.5 nm.

In accordance with the preparation step S1, the graphene-containing rare earth permanent magnet powder is orientated under a magnet field with a magnet field strength of 1.6 T.

In accordance with the preparation step S2, the isostatic pressing of the green body is conducted at a pressure of 230 MPa and a pressing time of 150 s.

In accordance with the preparation step S2, the sintering process comprises of the follow steps:

A: placing the isostatic pressing treated green body in a sintering furnace, closing the furnace lid and evacuating the furnace until the absolute vacuum degree in the furnace is below 0.1 Pa;

B: feeding the sintering furnace with argon until pressure in the sintering furnace reaches 60 Pa and keeping at this pressure; increasing temperature of the sintering furnace to 260° C. at a heating rate of 2.5° C./min and keeping at this temperature. The heating and holding time is 210 mins;

C: continuing to feed the sintering furnace with argon until the pressure in the sintering furnace reaches 200 Pa and maintaining at this pressure; increasing temperature of the sintering furnace to 760° C. at a heating rate of 3° C./min;

D: stop feeding argon and then evacuating the furnace until the absolute vacuum degree in the furnace is below 0.1 Pa; increasing temperature of the sintering furnace to 1050° C. at a heating rate of 2° C./min and keeping at this temperature. The heating and holding time is 300 mins.

In accordance with the preparation step S2, the graphene-containing rare earth permanent magnet material is obtained via first isostatic pressing of the green body obtained from the preparation step S1, sintering the isostatic pressing treated green body in a vacuum sintering furnace, and then tempering the sintered green body following a two-stage tempering process.

In accordance with the preparation step S2, the two-stage tempering process is conducted at 860° C. for 180 mins of a first stage and 550° C. for 180 mins of a second stage.

[The Third Embodiment]

The graphene-containing rare earth permanent magnet material in the third embodiment comprises 23.4 weight percent of neodymium, 6.6 weight percent of praseodymium, 1.2 weight percent of boron, 0.6 weight percent of cobalt, 0.15 weight percent of copper, 2.0 weight percent of lanthanum, 2.1 weight percent of cerium, 5 weight percent of graphene, a remainder being iron.

The preparation method of the graphene-containing rare earth permanent magnet material in the third embodiment is as follows:

S1: proportionally mixing a graphene powder with a magnet alloy powder to obtain a graphene-containing rare earth permanent magnet powder; the magnet alloy powder contains neodymium, praseodymium, boron, cobalt, copper, lanthanum, cerium and iron in proportion; orientating the graphene-containing rare earth permanent magnet powder under a magnet field with the protection of an inert gas, and pressing the oriented graphene-containing rare earth permanent magnet powder to form a green body;

S2: isostatic pressing of the green body obtained in preparation step S1; sintering the isostatic pressed green body in a sintering furnace; tempering the sintered green body to obtain a graphene-containing rare earth permanent magnet material.

In accordance with the preparation step S1, the magnet alloy powder is prepared by the following steps: mixing neodymium, praseodymium, boron, cobalt, copper, lanthanum, cerium and iron powder in proportion to form a magnet alloy; then smelting the magnet alloy to form a magnet alloy ingot; the magnet alloy ingot is made into thin magnet alloy sheets by a rapid solidification process; the thin magnet alloy sheets are then treated by hydrogen decrepitation to form magnet alloy fragments; the magnet alloy fragments are then processed into magnet alloy powders by jet milling.

In accordance with the preparation step S1, in the rapid solidification process, the processed molten state magnet alloy is poured onto a rotating water-cooled copper rolls for rapid quenching, with a rotation speed of 3 m/s. The thickness of the obtained thin magnet alloy sheets is 0.33 mm.

In accordance with the preparation step S1, the diameter of the magnet alloy powder is 0.5 nm-1.5 μm.

In accordance with the preparation step S1, the graphene-containing rare earth permanent magnet powder is orientated under a magnet field with a magnet field strength of 2.5 T.

In accordance with the preparation step S2, the isostatic pressing of the green body is conducted at a pressure of 280 MPa and a pressing time of 90 s.

In accordance with the preparation step S2, the sintering process comprises of the follow steps:

A: placing the isostatic pressing treated green body in a sintering furnace, closing the furnace lid and evacuating the furnace until the absolute vacuum degree in the furnace is below 0.1 Pa;

B: feeding the sintering furnace with argon until pressure in the sintering furnace reaches 100 Pa and keeping at this pressure; increasing temperature of the sintering furnace to 310° C. at a heating rate of 3.5° C./min and keeping at this temperature. The heating and holding time is 150 mins;

C: continuing to feed the sintering furnace with argon until the pressure in the sintering furnace reaches 250 Pa and maintaining at this pressure; increasing temperature of the sintering furnace to 820° C. at a heating rate of 4° C./min;

D: stop feeding argon and then evacuating the furnace until the absolute vacuum degree in the furnace is below 0.1 Pa; increasing temperature of the sintering furnace to 1140° C. at a heating rate of 3° C./min and keeping at this temperature. The heating and holding time is 240 mins.

In accordance with the preparation step S2, the graphene-containing rare earth permanent magnet material is obtained via first isostatic pressing of the green body obtained from the preparation step of S1, sintering the isostatic pressing treated green body in a vacuum sintering furnace, and then tempering the sintered green body following a two-stage tempering process.

In accordance with the preparation step S2, the two-stage tempering process is conducted at 940° C. for 120 mins of the first stage and 550° C. for 120 mins of the second stage.

[The Fourth Embodiment]

The graphene-containing rare earth permanent magnet material in the fourth embodiment comprises 22 weight percent of neodymium, 7.2 weight percent of praseodymium, 1.0 weight percent of boron, 0.45 weight percent of cobalt, 0.14 weight percent of copper, 2.2 weight percent of lanthanum, 1.8 weight percent of cerium, 4 weight percent of graphene, a remainder being iron.

The preparation method of the graphene-containing rare earth permanent magnet material in embodiment 4 is as follows:

S1: proportionally mixing a graphene powder with a magnet alloy powder to obtain a graphene-containing rare earth permanent magnet powder; the magnet alloy powder contains neodymium, praseodymium, boron, cobalt, copper, lanthanum, cerium and iron in proportion; orientating the graphene-containing rare earth permanent magnet powder under a magnet field with the protection of an inert gas, and pressing the oriented graphene-containing rare earth permanent magnet powder to form a green body;

S2: isostatic pressing the green body obtained in preparation step S1; sintering the isostatic pressed green body in a sintering furnace; tempering the sintered green body to obtain a graphene-containing rare earth permanent magnet material.

In accordance with the preparation step S1, the magnet alloy powder is prepared by the following steps: mixing neodymium, praseodymium, boron, cobalt, copper, lanthanum, cerium and iron powder in proportion to form a magnet alloy; then smelting the magnet alloy to form a magnet alloy ingot; the magnet alloy ingot is made into thin magnet alloy sheets by a rapid solidification process; the thin magnet alloy sheets are then treated by hydrogen decrepitation to form magnet alloy fragments; the magnet alloy fragments are then processed into magnet alloy powders by jet milling.

In accordance with the preparation step S1, in the rapid solidification process, the processed molten state magnet alloy is poured onto a rotating water-cooled copper rolls for rapid quenching, with a rotation speed of 2.8 m/s. The thickness of the obtained thin magnet alloy sheets is 0.3 mm.

In accordance with the preparation step S1, the diameter of the magnet alloy powder is 0.5 nm-1.5 nm.

In accordance with the preparation step S1, the graphene-containing rare earth permanent magnet powder is orientated under a magnet field with a magnet field strength of 2.2 T.

In accordance with the preparation step S2, the isostatic pressing of the green body is conducted at a pressure of 260 MPa and a pressing time of 100 s.

In accordance with the preparation step S2, the sintering process comprises of the follow steps:

A: placing the isostatic pressing treated green body in a sintering furnace, closing the furnace lid and evacuating the furnace until the absolute vacuum degree in the furnace is below 0.1 Pa;

B: feeding the sintering furnace with argon until pressure in the sintering furnace reaches 90 Pa and keeping at this pressure; increasing temperature of the sintering furnace to 280° C. at a heating rate of 3° C./min and keeping at this temperature. The heating and holding time is 180 mins;

C: continuing to feed the sintering furnace with argon until the pressure in the sintering furnace reaches 220 Pa and maintaining at this pressure; increasing temperature of the sintering furnace to 790° C. at a heating rate of 3.5° C./min;

D: stop feeding argon and then evacuating the furnace until the absolute vacuum degree in the furnace is below 0.1 Pa; increasing temperature of the sintering furnace to 1120°

C. at a heating rate of 2.5° C./min and keeping at this temperature. The heating and holding time is 280 mins.

In accordance with the preparation step S2, the graphene-containing rare earth permanent magnet material is obtained via first isostatic pressing of the green body obtained from the preparation step of S1, sintering the isostatic pressing treated green body in a vacuum sintering furnace, and then tempering the sintered green body following a two-stage tempering process.

In accordance with the preparation step S2, the two-stage tempering process is conducted at 920° C. for 160 mins of the first stage and 580° C. for 150 mins of the second stage.

Contents of the rest embodiments of the present invention are similar to that of the first embodiment and for simplicity, they will not be repeated here.

[Comparative example 1]

The differences between the comparative example 1 and the first embodiment of the present invention lies in the different compositions of the magnet alloy. The permanent magnet material of the comparative example 1 has a composition of 21.5 weight percent of neodymium, 6.9 weight percent of praseodymium, 1.1 weight percent of boron, 0.5 weight percent of cobalt, 0.12 weight percent of copper, 2.2 weight percent of lanthanum, 1.9 weight percent of cerium, a remainder being iron.

The sintered rare earth permanent magnet materials obtained from comparative example 1 and the embodiments 1-4 of the present invention are then processed in to a Φ 10 mm×7 mm cylinder respectively and tested according to GB/T 13560-2017. The performances are shown in the following table:

| | Item | | |
|---|---|---|---|
| | Remanence $B_r$ (20° C.) | Remanence $B_r$ (450° C.) | Intrinsic coercive force $H_{cj}$ |
| | Unit | | |
| | T | T | KA/m |
| Embodiment 1 | 1.41 | 1.17 | 1494 |
| Embodiment 2 | 1.37 | 1.08 | 1340 |
| Embodiment 3 | 1.44 | 1.13 | 1395 |
| Embodiment 4 | 1.43 | 1.11 | 1432 |
| Comparative example 1 | 1.34 | 0.92 | 1288 |

There are no defects like cracks, voids, impurities or exfoliations on the surface of the Nd—Fe—B magnets obtained from comparative example 1 and embodiments 1-4 of the present invention. The electrical resistivity of the magnet in the first embodiment is $1.1\times10^{-4}$ Ω·m. By means of incorporating graphene into Nd—Fe—B alloy powders and compounding it with components like neodymium, praseodymium, boron, cobalt, copper, lanthanum and cerium, and then adjusting the ratios of each component, the graphene-containing rare earth permanent magnet material with good temperature resistance, conductivity and magnet properties is obtained. The graphene-containing rare earth permanent magnet material of the present invention exhibits excellent properties even without any heavy rare earth elements like terbium or dysprosium, which dramatically reduces the cost, promotes the effective utilization of rare earth resources and improves product quality.

The present invention is not limited by the implementation schemes mentioned in the above embodiments, although they do show the preferred implementation schemes. All variations, modifications and replacements to the disclosed embodiments which are apparent to those skilled in the art and do not depart from the concept of the present invention fall in the scope of the present invention.

What is claimed is:

1. A preparation method of a graphene-containing rare earth permanent magnet material comprising the following steps:

S1. proportionally mixing a graphene powder with a magnet alloy powder to obtain a graphene-containing rare earth permanent magnet powder, the magnet alloy powder containing neodymium, praseodymium, boron, cobalt, copper, lanthanum, cerium and iron in proportion; orientating the graphene-containing rare earth permanent magnet powder under a magnet field with a protection of an inert gas, and pressing the oriented graphene-containing rare earth permanent magnet powder to form a green body;

S2. isostatic pressing the green body obtained from S1; sintering the isostatic pressed green body in a sintering furnace; and tempering the sintered green body to obtain a graphene-containing rare earth permanent magnet material.

2. The preparation method of claim 1, wherein in the Step S1, the magnet alloy powder is prepared by the following steps: mixing neodymium, praseodymium, boron, cobalt, copper, lanthanum, cerium and iron powder in proportion to form a magnet alloy; then smelting the magnet alloy to form a magnet alloy ingot; the magnet alloy ingot is made into thin magnet alloy sheets by a rapid solidification process; the thin magnet alloy sheets are then treated by hydrogen decrepitation to form a magnet alloy fragments; the magnet alloy fragments are then processed into magnet alloy powders by jet milling.

3. The preparation method of claim 2, wherein in the rapid solidification process, the processed molten state magnet alloy is poured onto a rotating water-cooled copper rolls for rapid quenching, with a rotation speed of 2.5_m/s to 3_m/s.

4. The preparation method of claim 1, wherein in the Step S1, the magnet alloy powder has a diameter of 0.5 μm to 1.5 μm.

5. The preparation method of claim 1, wherein in the Step S1, the graphene-containing rare earth permanent magnet powder is orientated under a magnet field with a magnet field strength of 1.6 T to 2.5 T.

6. The preparation method of claim 1, wherein in the Step S2, a pressure of the isostatic pressing is 230_MPa to 280_MPa, a pressing time is 90s to 150s.

7. The preparation method of claim 1, wherein in the Step S2, the green body is treated by isostatic pressing, and then placed in a vacuum sintering furnace for sintering, followed by a two-stage tempering treatment to obtain the graphene rare earth permanent magnet material.

8. The preparation method of claim 1, wherein in the Step S2, a temperature of a first tempering treatment is 860° C. to 940° C., and the temperature is maintained for 120_mins to 180_mins, while a temperature of a second tempering heat treatment is 550° C. to 600° C., and the temperature is maintained for 120_mins to 180 mins.

* * * * *